US005405086A

United States Patent [19]

Kränzle

[11] Patent Number: 5,405,086

[45] Date of Patent: Apr. 11, 1995

[54] HIGH-PRESSURE CLEANER

[76] Inventor: Josef Kränzle,
Rudolf—Diesel—Strasse 20, D-7918
Illertissen, Germany

[21] Appl. No.: 90,086

[22] PCT Filed: Nov. 23, 1992

[86] PCT No.: PCT/EP92/02692

§ 371 Date: Sep. 21, 1993

§ 102(e) Date: Sep. 21, 1993

[87] PCT Pub. No.: WO93/09886

PCT Pub. Date: May 27, 1993

[30] Foreign Application Priority Data

Nov. 22, 1991 [DE] Germany ..... 41 38 451.2

[51] Int. Cl.[6] ..... B05B 7/04; B05B 7/24

[52] U.S. Cl. ..... 239/172; 239/310; 239/532

[58] Field of Search ..... 239/146, 149, 172, 532, 239/526, 304, 310; 15/323; 425/500, 517

[56] References Cited

U.S. PATENT DOCUMENTS

| | | | |
|---|---|---|---|
| 2,819,485 | 1/1958 | Sparklin | 15/323 |
| 3,064,904 | 11/1956 | Roberts | 239/146 X |
| 3,504,858 | 4/1970 | Liddiard | 239/172 |
| 4,222,145 | 9/1980 | Lowder | 15/323 X |
| 4,761,850 | 8/1988 | Romeo et al. | 15/323 |
| 4,810,169 | 3/1989 | Kranzle . | |
| 4,955,106 | 9/1990 | Stein et al. | 15/323 X |
| 5,014,385 | 5/1991 | Bradd et al. | 15/323 |
| 5,116,425 | 5/1992 | Ruet | 239/532 X |

FOREIGN PATENT DOCUMENTS

| | | |
|---|---|---|
| 0249153 | 12/1987 | European Pat. Off. . |
| 3400568 | 7/1985 | Germany . |
| 9104335 | 4/1991 | Germany . |
| 2084685 | 8/1990 | United Kingdom . |
| 2228558 | 8/1990 | United Kingdom . |

*Primary Examiner*—Andres Kashnikow
*Assistant Examiner*—Kevin Weldon
*Attorney, Agent, or Firm*—Knobbe, Martens, Olson & Bear

[57] ABSTRACT

In order to reduce the storage space required for accessories, such as washing gun (10), spray lance (18), pressure hose and electric cable, in a high-pressure cleaner (1), insertion receptacles (16, 17) are arranged in the housing (2) for plugging in the washing gun (10) and spray lance (18), so that the accessories are safely stored and quickly accessible. In addition, the pressure hose is clamped and held by its own elasticity between two opposing hose hooks. A solution is also proposed for safely retaining and at the same time for quickly unwinding and rewinding the cable roll, in that a cable hook (13) is movable with respect to a second stationary cable hook (14).

10 Claims, 1 Drawing Sheet

HIGH-PRESSURE CLEANER

TITLE OF THE INVENTION

High-Pressure Cleaner

BACKGROUND OF THE INVENTION

1. Field of the Invention

This invention relates to a high-pressure cleaner with the precharacterizing features of claim 1.

2. Description of the Prior Art

A high-pressure cleaning apparatus is known from DE-GM 91 04 335 which is provided with rollers on the underside of the housing of the apparatus in order to avoid relatively tiring carrying of the apparatus, so that in particular heavy high-pressure cleaners can be easily transported. In addition a transport handle of hoop form is provided so that the high-pressure cleaner can be transported without great effort to any place of use, even over long distances. In such high-pressure cleaner however numerous accessories are needed for operation, namely a washing gun, at least one spray lance, a pressure hose and an electric cable, which also have to be carried on the apparatus separately, without suitable receptacles. In addition, in storing the high-pressure cleaner, these accessories are mostly only stored loose beside the apparatus, so that considerable storage space is hereby lost. In the reference cited above there are no proposals for storage and transport of the accessories necessary for operating the high-pressure cleaner.

In EP-B 0 249 153 a portable high-pressure cleaner is described on whose housing a plurality of lateral hooked projections are provided for receiving and holding in place the spray lances pertaining to the washing gun. Furthermore on the rear side of the housing an upwardly open drum is provided, in which the pressure hose can be placed. This however requires precise rolling up of the pressure hose, which can take considerable time. The transport of this portable high-pressure cleaner is tiring, especially with a heavy duty model, on account of the relatively high weight. In addition, the accessories can easily fall out of their receptacles, e.g. on banging into a door. From DE-A 3 400 568 there is known a high-pressure cleaner in which the whole spraying lance can be stuck into a heatable receiving chamber open below, to prevent the handle freezing up. The tubular receiving chamber is directed obliquely downwards for this, so that this receptacle needs considerable space.

SUMMARY OF THE INVENTION

The invention is thus based on the object of providing a space-saving and secure transport and storage facility for the accessories needed to operate the high-pressure cleaner, while getting hold of the accessories and putting them to use is possible with ease and quickly.

This object is met by a high-pressure cleaner according to the features of claim 1 or 5 or 7.

By means of the insertion receptacles provided in the housing for inserting the washing gun and the spray lance, these are held reliably during transport and are always ready to hand for use. In addition the pressure hose can remain connected, so that time-saving transport and rapid grasping or sticking back of the washing gun are facilitated, especially with changing sites of use, e.g. in cleaning facades. By virtue of the separate insertion of the washing gun on the one hand and the spray lance on the other, each in an insertion receptacle, the overall height of the high-pressure cleaner is relative small when put away, so that only a small space is required.

Furthermore the mutually spaced hose hooks fitted to the housing and whose ends face one another are of independent significance. The pressure hose can thereby be gripped and fixed between the hose hooks, without laborious rolling up to a specific diameter. It is also possible to withdraw individual loops, as needed, without the whole coil being spoilt. By virtue of the simple insertion of the hose loops, the pressure hose can remain connected to the washing gun. The hose loops assume something of a figure of eight configuration in the fixing position between the two hose hooks, so that the pressure hose is held securely by its own elasticity.

The implementation of the cable holder is of further independent significance, the winding on to two cable hooks being known per se. The winding up and unwinding however take a long time while winding on to one cable hook only runs the risk of the cable falling off in transport. By means of the ability of the cable hooks to move towards and away from one another which is now proposed, a wound coil of cable can be put over both cable hooks with the cable hooks pushed together and then one cable hook can be pushed away from the other, so that the coil of cable is locked in the recesses of the cable hooks. To remove the cable coil, the one cable hook can be moved relative to the other, so that the cable coil can be taken off in simple manner. In the preferred embodiment the slidable cable hook is provided on an auxiliary container for cleaning chemicals, which is movably fixed on a transport handle for the high-pressure cleaner.

Further advantageous developments are the subject matter of the dependent claims.

An embodiment will be explained and described in more detail with reference to the drawings, in which:

BRIEF DESCRIPTION OF THE PREFERRED EMBODIMENTS

Figure 1:
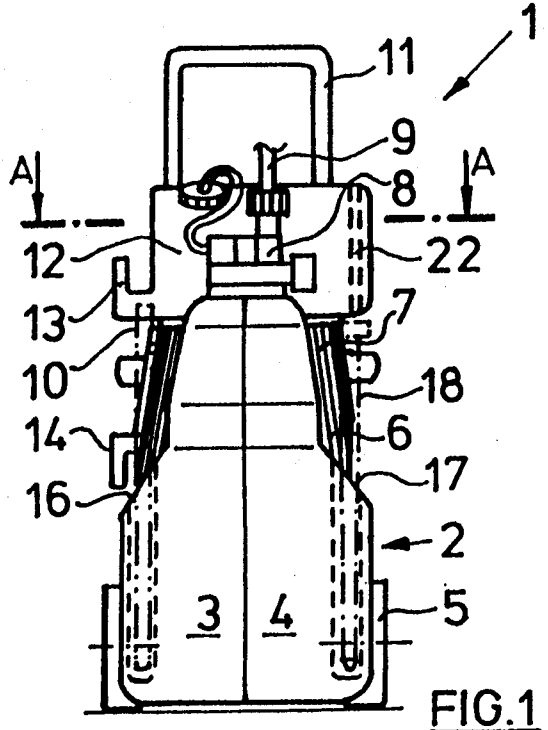
FIG. 1 is a front view of a high-pressure cleaner.

A high-pressure cleaner 1 standing upright is shown in FIG. 1 in front view, the major part being surrounded by a housing 2. The housing 2 is separated at the longitudinal central plane and thus consists of two housing half shells 3, 4. Support wheels 5 are provided on the underside of the housing 2 and serve for easy transport of the high-pressure cleaner 1. The housing 2 encloses an electric motor 6 and a high-pressure pump 7 flanged on to the motor, while leaving its cooling fins free. A pump head 8 with various valves is connected to the upper end of the high-pressure pump 7 and a high-pressure hose 9 is in turn connected to the pump head for connection of a washing gun 10, here shown only schematically (chain-dotted lines; cf. FIG. 2 also). An upstanding hoop 11 serves with the support wheels 5 for easy transport of the high-pressure cleaner 1. When not in use, the high-pressure cleaner 1 is placed in the position here shown. An auxiliary container 12 for cleaning chemicals is fixed between the tubes of the hooped transport handle 11 and from this the high-pressure pump 7 sucks cleaning additives into the high pressure water when required.

At the here left end of the auxiliary container 12 there is provided a cable hook 13, which is arranged vertically above a further cable hook 14 of like form. The cable hook 14 is cast on the housing 2, here on the left housing half shell 3. The two cable hooks 13 and 14 serve to receive a cable 15, as will be explained in more detail in conjunction with FIG. 3.

At the two front corners of the housing 22 there are provided two quiver-like insertion receptacles 16 and 17 for insertion of the washing gun 10 and a spray lance 18 which can be connected thereto. The washing gun 10 with the spray lance 18 connected thereto has a length approximately twice the height of the high-pressure cleaner 1. Thus one insertion receptacle each are provided for the washing gun 10 with the handle and for the spray lance 18, namely the quiver-like insertion receptacles 16 and 17, in order that the space demands of the high-pressure cleaner 1 shall be a small as possible. In addition the second insertion receptacle 17 offers the possibility of carrying different spray lances 18, whereby a clip receptacle 22 (cf. also FIG. 4) can be provided on the auxiliary container 12 for an additional spray lance 18.

Figure 2:
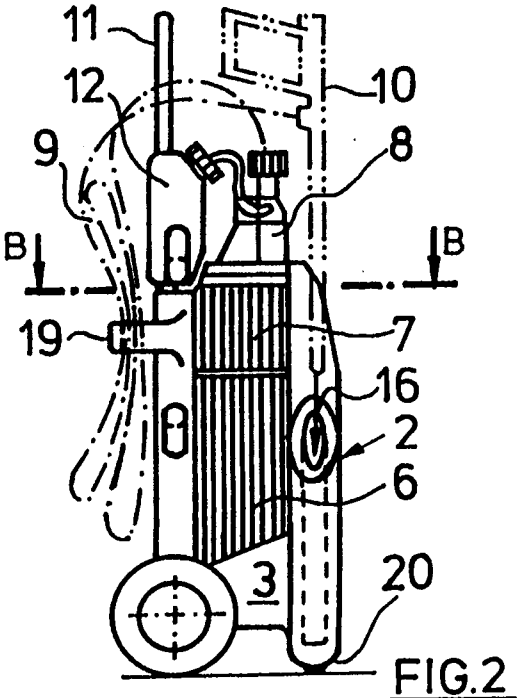
FIG. 2 is a side view of the high-pressure cleaner according to FIG. 1.

The corresponding side view is shown in FIG. 2, where it is possible to see especially the space-saving stowage of the accessories for the high-pressure cleaner 1. This is given in the first place by the quiver-like insertion receptacles 16 and 17, whose depth corresponds to approximately half the length of the washing gun 10 and spray lance 18 respectively, so that these are securely stowed even with inclined transport of the high-pressure cleaner 1. In addition the vertical disposition of the insertion receptacles 16, 17 in the position of the high-pressure cleaner 1 when not in use here shown facilitates rapid grasping of the washing gun 10. As is apparent the pressure hose 9 shown for better visibility in chain dotted lines can remain connected to the washing gun 10. The two hose hooks 19 here project to the rear side of the high-pressure cleaner 1 from the housing 2, in order to receive the pressure hose 9 therebetween (cf. FIG. 3) on account of its elasticity. As is apparent, the insertion receptacles 16, 17 are extended down to the plane of the support wheels 5, so that the undersides exhibit a kind of support foot 20 for the support of the high-pressure cleaner 1 in the position when not in use here shown. It should be noted that the high-pressure cleaner 1 can also be operated in a horizontal position.

Figure 3:
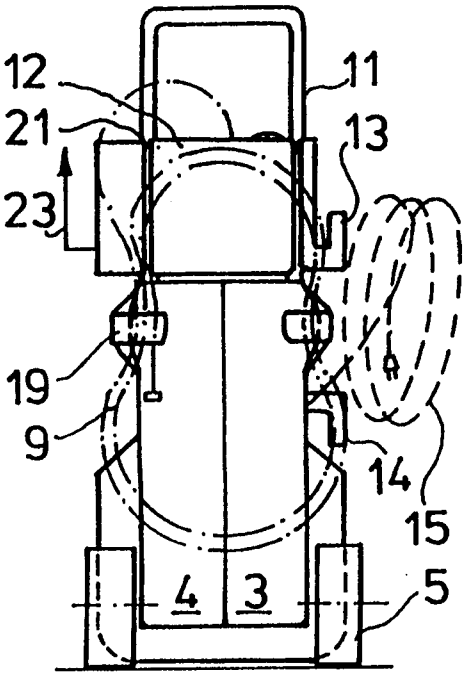
FIG. 3 is a rear view of the high-pressure cleaner according to FIGS. 1 and 2.

The rear side of the high-pressure cleaner 1 according to FIGS. 1 and 2 is shown in FIG. 3. The grasping of the hose 9 shown in chain dotted lines is especially to be seen, whereby this assumes a somewhat figure of eight shape in the fixed position between the two hose hooks 19. By virtue of this especially simple retention individual loops of the pressure hose 9 can be withdrawn from the hose hooks 19, without the retention of the other loops between the hose hooks 19 being affected. Since the pressure hose 9 can also remain connected to the washing gun 10, the high-pressure cleaner 1 can be put into operation particularly rapidly after a move.

In addition the special nature of the cable retention will be explained in more detail. The cable leads in the region of the lower cable hook 14 to the electric motor 6 and normally assumes the coiled up form here shown. In this arrangement the cable coil 15 can be slipped over the lower and upper cable hooks 13, 14. Then the upper cable hook 13 can be pushed upwardly according to the arrow 23 because of the slidable fixing on the auxiliary container 12, so that the cable loops are retained in interlocked manner between the cable hooks 13 and 14. If now the whole coil of cable 15 is to be released, the upper cable hook 13 can be pushed down opposite to the direction of the arrow 23, so that the whole cable coil 15 can be taken over the hooks 13 and 14 without being unwound.

Figure 4:
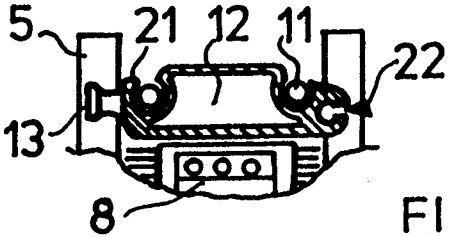
FIG. 4 is a section on the section line A—A in FIG. 1.

The slidable fixing of the upper cable hook 13 to the tubes of the transport handle 11 is shown in more detail in FIG. 4. For the slidable fixing there are provided clips 21 which partially surround the tubes. The closeness of the fit is so selected that the cable hook 13 maintains its position on the transport handle 11 without additional application of force but is nevertheless easily movable up and down. The clips 21 are both here provided on the auxiliary container 12 but the upper cable hook movable relative to the lower cable hook 14 can also be fixed slidably on a separate component.

On the here right hand side of the auxiliary container 12 there is further fixed a clip receptacle 22 in which a further spray lance 18 can be inserted and carried, as is sensible for vehicle washing for example, when a bent spray lance for cleaning under the body is to be used in addition to the usual spray lance 18, which can be carried in the insertion receptacle 17.

Figure 5:
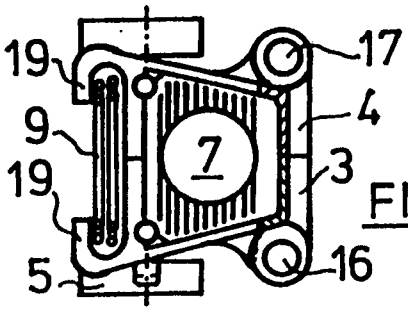
FIG. 5 is a section along the line B—B in FIG. 2.

A sectional view on the section line B—B in FIG. 2 is shown in FIG. 5. The quiver-like form of the insertion receptacles 16 and 17 is especially apparent from this as well as the hook shape of the two hose hooks 19, in which the pressure hose 9 is fitted and securely held on account of its elasticity.

I claim:

1. A high-pressure cleaner comprising:

a high-pressure pump which is at least partially surrounded by a housing;

a washing gun which is connected to the high-pressure pump by a pressure hose;

a first insertion receptacle on the housing for holding the washing gun;

a spray lance for attachment to said washing gun; and a second insertion receptacle on the housing for holding said spray lance, wherein the two insertion receptacles are integrally molded symmetrically at the side edges of the housing.

2. A high-pressure cleaner according to claim 1, wherein both insertion receptacles are vertical when the high-pressure cleaner is upright.

3. A high-pressure cleaner according to claim 1, wherein the depth of the insertion receptacles is approximately half the length of the washing gun.

4. A high-pressure cleaner according to claim 1, wherein bottom ends of the insertion receptacles form support feet when the high-pressure cleaner is upright.

5. A high-pressure cleaner with a high-pressure pump which is at least partially surrounded by a housing, and with a washing gun which is connected to the high-pressure pump by a pressure hose, wherein two mutually spaced hose hooks having ends facing towards each other are provided on a surface of the housing, for insertion of the pressure hose between said hooks.

6. A high-pressure cleaner according to claim 5, wherein the hose hooks are molded integrally with the housing.

7. A high-pressure cleaner comprising:

a high-pressure pump which is at least partially surrounded by a housing;

a washing gun which is connected to the high-pressure pump by a pressure hose;

a first cable hook and an upstanding transport handle located on a side of the housing; and a second cable hook spaced from the first cable hook slidably fixed on the transport handle, so that one cable hook is movable directly towards or away from the other cable hook for adjusting the spacing between the two cable hooks.

8. A high-pressure cleaner according to claim 7, wherein the second cable hook is arranged on an auxiliary container for cleaning chemicals, which is slidably fixed on the transport handle.

9. A high-pressure cleaner according to claim 8, wherein the auxiliary container is fixed on the transport handle by clips partially surrounding tubes thereof.

10. A high-pressure cleaner according to claim 8, wherein a clip receptacle for a further spray lance is formed on a surface of the auxiliary container opposed to the second cable hook.

* * * * *